US010200784B2

(12) United States Patent
Yamazaki et al.

(10) Patent No.: US 10,200,784 B2
(45) Date of Patent: Feb. 5, 2019

(54) SPEAKER BOX STRUCTURE OF ELECTRONIC DEVICE

(71) Applicant: Yamaha Corporation, Hamamatsu-shi, Shizuoka-ken (JP)

(72) Inventors: Yu Yamazaki, Hamamatsu (JP); Takuya Otsuka, Hamamatsu (JP); Tsukasa Suenaga, Iwata (JP)

(73) Assignee: Yamaha Corporation, Hamamatsu-Shi (JP)

( * ) Notice: Subject to any disclaimer, the term of this patent is extended or adjusted under 35 U.S.C. 154(b) by 0 days.

(21) Appl. No.: 14/880,041

(22) Filed: Oct. 9, 2015

(65) Prior Publication Data

US 2016/0105743 A1 Apr. 14, 2016

(30) Foreign Application Priority Data

Oct. 10, 2014 (JP) ..... 2014-208827

(51) Int. Cl.
*H04R 1/28* (2006.01)

(52) U.S. Cl.
CPC ..... *H04R 1/2888* (2013.01)

(58) Field of Classification Search
CPC ..... H04R 1/2888; H04R 1/2896; H04R 1/02; H04R 1/28; H04R 1/2892; H04R 1/026; H04R 1/288; G10H 1/32; G10H 2210/275; Y10S 84/17; Y10S 84/01
See application file for complete search history.

(56) References Cited

U.S. PATENT DOCUMENTS 2,766,839 A * 10/1956 Baruch ..... H04R 1/2811 181/146
3,136,383 A * 6/1964 Hopkins ..... H04R 1/227 181/145
3,512,605 A * 5/1970 McCorkle ..... B60N 2/4876 181/141

(Continued)

FOREIGN PATENT DOCUMENTS

CN 10-1149917 A 3/2008
CN 202395941 U 8/2012

(Continued)

OTHER PUBLICATIONS

Notification of the First Office Action dated Feb. 27, 2018, for CN Application No. 201510651590.9, with English translation, 19 pages.

(Continued)

*Primary Examiner* — Fan S Tsang
*Assistant Examiner* — Angelica M McKinney
(74) *Attorney, Agent, or Firm* — Morrison & Foerster LLP

(57) ABSTRACT

A speaker box structure of an electronic device, includes: a left side speaker box having: a left side wall part; and a first opposed wall part which has a region where a distance in a lateral direction from the left side wall part to the first opposed wall part continuously varies; and a right side speaker box having: a right side wall part; and a second opposed wall part which is opposed to the first opposed wall part in an intermediate part in the lateral direction, and which has a region where a distance in the lateral direction from the right side wall part to the second opposed wall part continuously varies.

12 Claims, 6 Drawing Sheets

(56) References Cited

U.S. PATENT DOCUMENTS 3,608,665 A * 9/1971 Drisi ..... H04R 1/227 181/147
3,643,000 A * 2/1972 Andersen ..... G10H 1/0091 381/1
4,042,791 A * 8/1977 Wiseman ..... B60N 2/4876 181/141
5,248,846 A * 9/1993 Koike ..... G10H 1/0091 84/718
5,335,283 A * 8/1994 Torii ..... G10H 1/0091 181/145
5,590,771 A * 1/1997 Cota ..... A45C 9/00 190/102
D598,899 S * 8/2009 Tkachuk ..... D14/216
8,039,725 B2 10/2011 Kato et al.
8,193,438 B2 * 6/2012 Hoshino ..... G10H 1/32 84/644
8,699,743 B2 * 4/2014 Moomey ..... H03F 3/183 381/345
2004/0173086 A1 * 9/2004 Sato ..... G10H 1/32 84/745
2005/0052837 A1 * 3/2005 Kota ..... G06F 1/1624 361/679.56
2005/0066798 A1 * 3/2005 Naito ..... G10H 1/32 84/743
2007/0092096 A1 * 4/2007 Litovsky ..... H04R 1/2834 381/349
2008/0072747 A1 3/2008 Nishida
2011/0013782 A1 1/2011 Moomey
2012/0222541 A1 9/2012 Ishimura et al.
2012/0314888 A1 * 12/2012 Tracy ..... H04R 1/026 381/182

FOREIGN PATENT DOCUMENTS

CN 10-2654999 A 9/2012
JP H04-241395 A 8/1992
JP H05-093191 U 12/1993
JP 2541017 B2 10/1996
JP 10-013978 A 1/1998
JP 2010-152232 A 7/2010
JP 2012-198526 A 10/2012

OTHER PUBLICATIONS

Notification of Reasons for Refusal dated Jun. 26, 2018, for JP Application No. 2014-208827, with English translation, five pages.

* cited by examiner

SPEAKER BOX STRUCTURE OF ELECTRONIC DEVICE

CROSS-REFERENCE TO RELATED APPLICATION(S)

This application is based upon and claims the benefit of priority from prior Japanese patent application No. 2014-208827, filed on Oct. 10, 2014, the entire contents of which are incorporated herein by reference.

BACKGROUND

The present invention relates to a speaker box structure of an electronic device which includes a left side and a right side speaker boxes.

There are electronic musical instruments, acoustic equipments and so on each including a left side and a right side speaker boxes. It has been generally known that bass is enriched, in case where capacity of the speaker box is increased. In view of the above, in Japanese Patent No. 2541017, for the purpose of increasing the capacity of the speaker box in an electronic keyboard as large as possible, it is proposed to increase the capacity of the speaker box for the bass, by utilizing a space below a keyboard and a panel. In a bass reflex speaker device in JP-A-H10-13978, such a design that occurrence of noises caused by a fluid change as a sound in a region surrounding a port is reduced to the least is disclosed.

However, because the related-art speaker box basically has a parallelepiped shape, clear standing waves are likely to be formed by reflection of sounds from an inner wall. When the standing waves are enclosed in the speaker box, disturbance in characteristics of the sounds tends to increase.

SUMMARY

It is an object of the invention to provide a speaker box structure of an electronic device capable of restraining occurrence of standing waves.

According to an aspect of the invention, there is provided a speaker box structure of an electronic device, the speaker box structure comprising: a left side speaker box having: a left side wall part; and a first opposed wall part which has a region where a distance in a lateral direction from the left side wall part to the first opposed wall part continuously varies; and a right side speaker box having: a right side wall part; and a second opposed wall part which is opposed to the first opposed wall part in an intermediate part in the lateral direction, and which has a region where a distance in the lateral direction from the right side wall part to the second opposed wall part continuously varies.

The first opposed wall part of the left side speaker box and the second opposed wall part of the right side speaker box may respectively have portions which are overlapped with each other in a front-rear direction.

The first opposed wall part of the left side speaker box and the second opposed wall part of the right side speaker box may be inclined in the same direction over entire regions, as seen in a plan view.

The left side speaker box and the right side speaker box may be higher in a rearward, as seen in a side view, and the first opposed wall part and the second opposed wall part may be so inclined as to be positioned rightward in the rearward, as seen in the plan view.

The speaker box structure may further comprise: a frame which includes a left side swelled part and a right side swelled part which are swelled; and a plate member which is a separate body independent from the frame, and which is fixed to the frame so as to cover the left side swelled part and the right side swelled part from a side opposite to a side where the left side swelled part and the right side swelled part are swelled, thereby to forma space for the left side speaker box and a space for the right side speaker box.

An electronic component or a wiring may be disposed in a valley part which is formed between the left side swelled part and the right side swelled part.

At least one of the left side swelled part and the right side swelled part may have a stepped part which is lower than an outward region in the lateral direction.

An electronic component or a wiring may be disposed on the stepped part.

DETAILED DESCRIPTION OF EXEMPLARY EMBODIMENTS

Figure 1A:
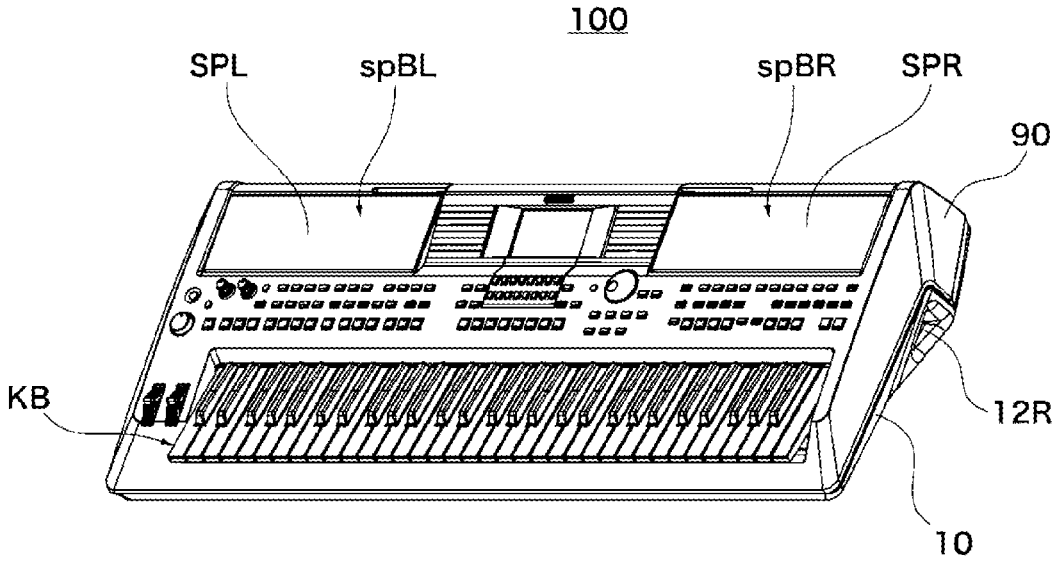
FIG. 1A is a perspective view of an electronic device to which a speaker box structure according to a first embodiment of the invention is applied.

Now, embodiments of the invention will be described referring to the drawings.

First Embodiment

FIG. 1A is a perspective view of an electronic keyboard to which a speaker box structure according to a first embodiment of the invention is applied. In this embodiment, an electronic keyboard 100 is exemplified as the electronic device. This electronic keyboard 100 has a keyboard part KB. A direction in which keys are arranged in the keyboard part KB is referred to as a lateral direction. Right and left sides are called, on the basis of a direction as seen from a player. In a front-rear direction, a side where the keyboard KB is provided is referred to as a front side.

A case body of the electronic keyboard 100 includes an upper case 90, a lower case 10, and a bottom plate 80 (which will be described below, referring to FIGS. 3A and 3B). The case body is provided with a left side speaker box spBL and a right side speaker box spBR. The speaker boxes spBL, spBR respectively have speakers SPL, SPR which are directed upward. The speakers SPL, SPR are covered with nets.

Figure 1B:
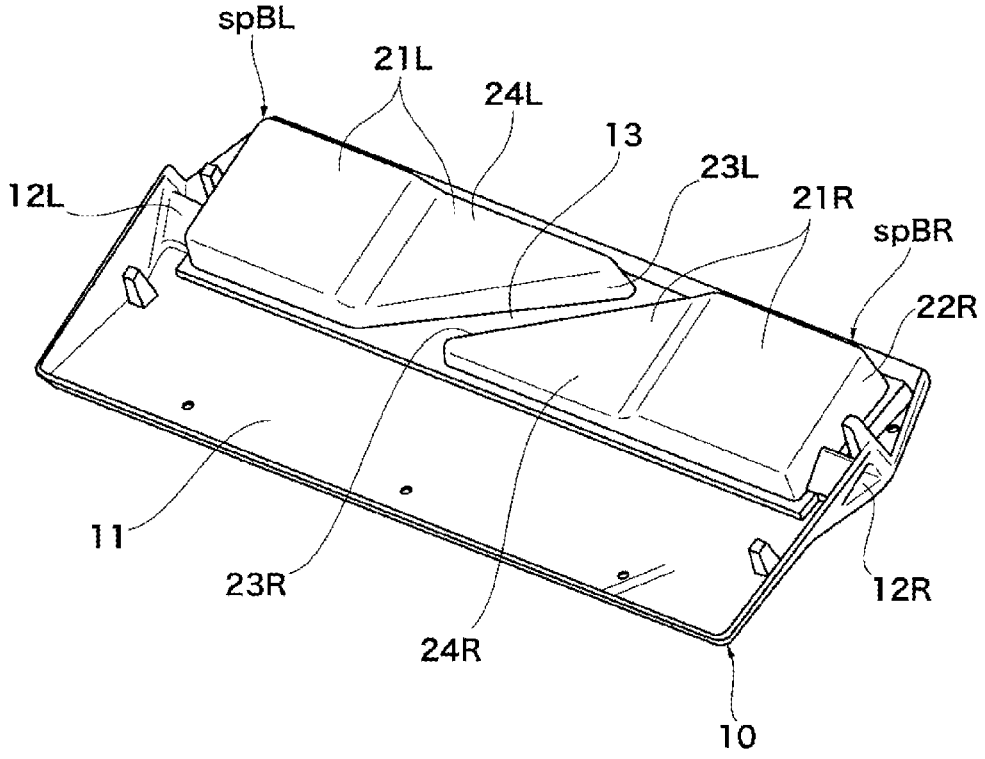
FIG. 1B is a perspective view of a lower case, as seen from the right of a front side.

FIG. 1B is a perspective view of the lower case 10, as seen from the right of the front side. The lower case 10 is integrally formed of resin or the like. A front half part of the lower case 10 is formed as a keyboard disposing part 11 which is substantially flat, and on which the keyboard KB is disposed. In the rear of the keyboard disposing part 11, a left side swelled part 21L and a right side swelled part 21R both of which are swelled upward are formed. A valley part 13 which is inclined to the right in the rearward in a plan view is formed between the left side swelled part 21L and the right side swelled part 21R. Therefore, the left side swelled part 21L and the right side swelled part 21R are separated to the left and right, by the valley part 13 as a border. A right half of the left side swelled part 21L is formed as a stepped part 24L which is stepped lower than a left half thereof. In the same manner, a left half of the right side swelled part 21R is formed as a stepped part 24R which is stepped lower than a right half thereof.

Figure 2A:
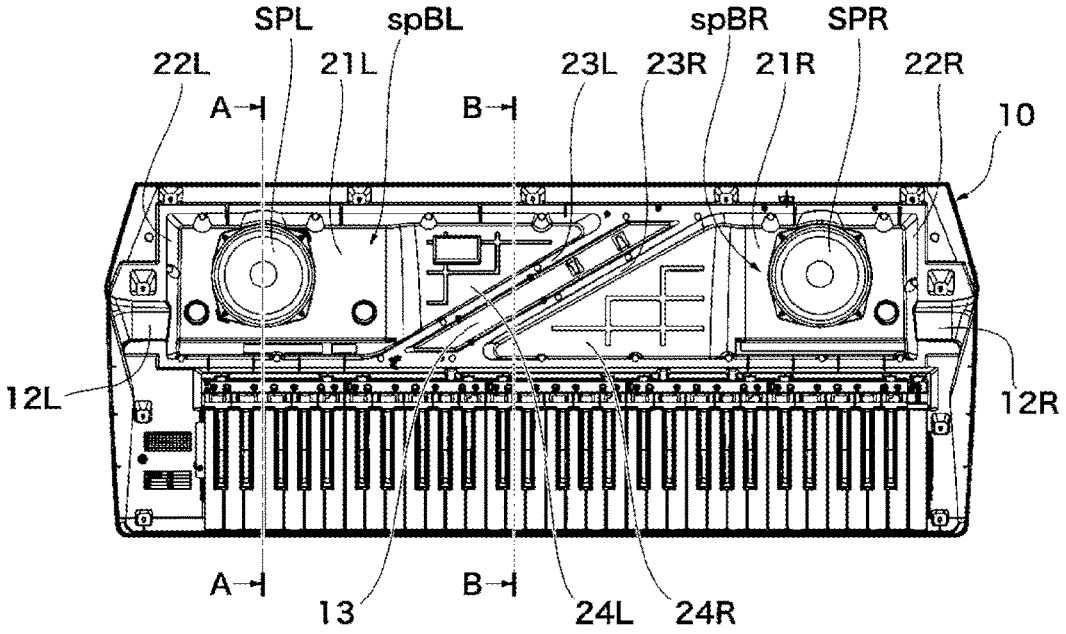
FIG. 2A is a plan view of an electronic keyboard in a state where an upper case is removed.
Figure 2B:
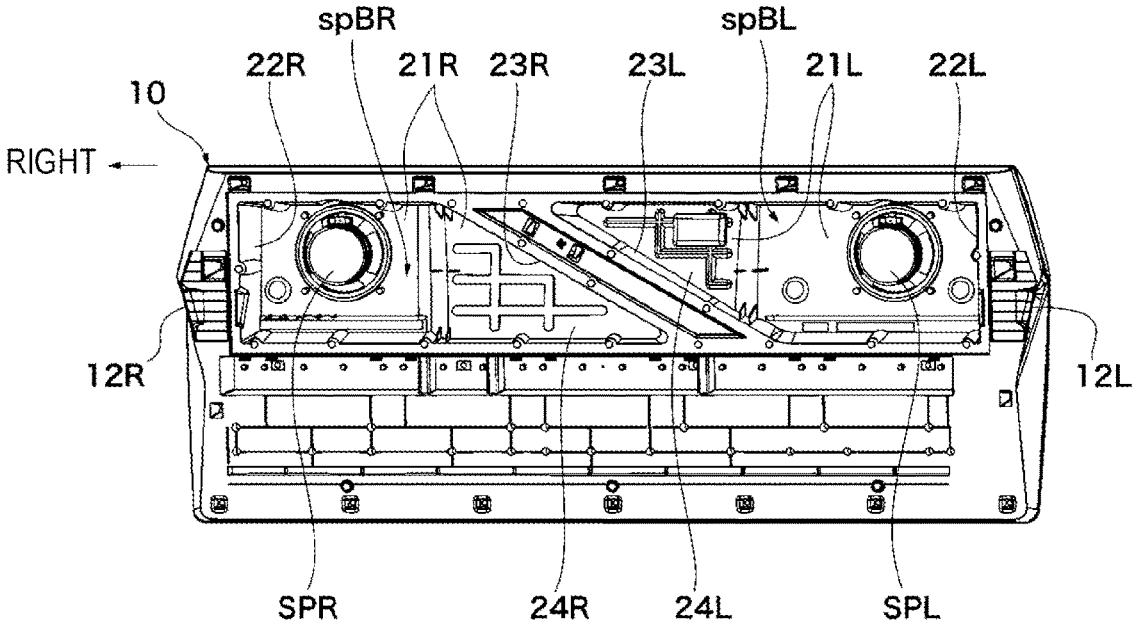
FIG. 2B is a bottom view of the electronic keyboard in a state where a bottom plate is not provided.

FIG. 2A is a plan view of the electronic keyboard 100 in a state where the upper case 90 is removed. FIG. 2B is a bottom view of the electronic keyboard in a state where the bottom plate 80 (FIGS. 3A, 3B) is not provided. FIGS. 3A and 3B are sectional views respectively taken along a line A-A and a line B-B in FIG. 2A.

Figure 3A:
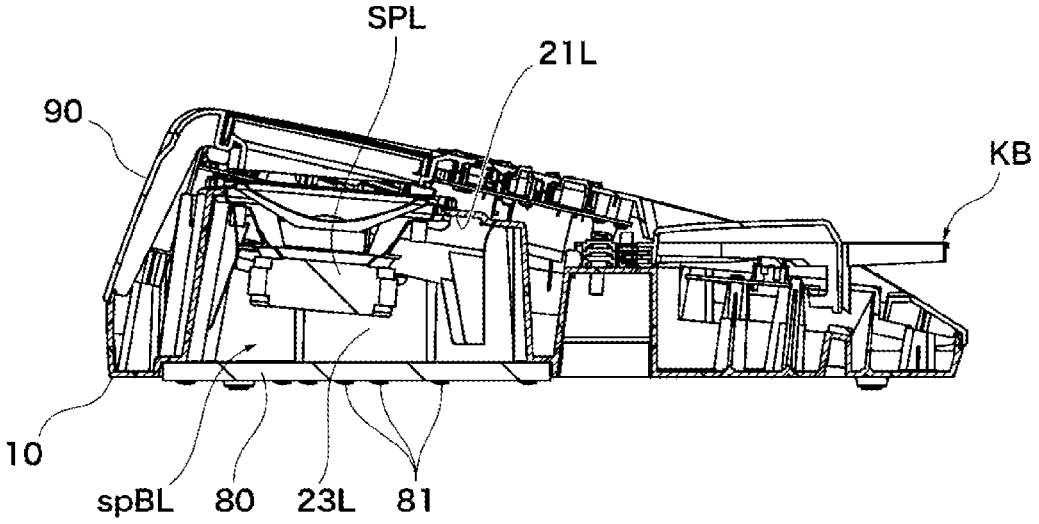
FIG. 3A is a sectional view taken along a line A-A in FIG. 2A.
Figure 3B:
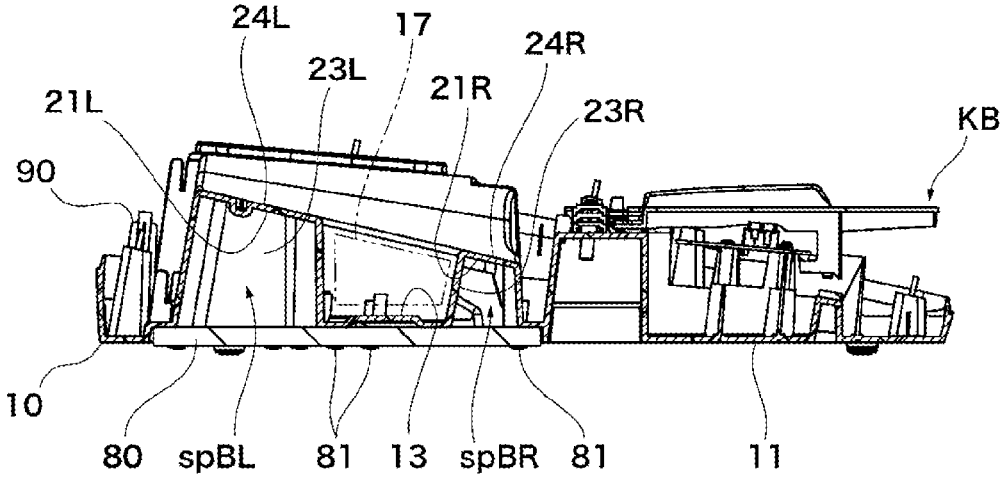
FIG. 3B is a sectional view taken along a line B-B in FIG. 2A.

The bottom plate 80 which is shown in FIGS. 3A, 3B is a plate member formed of resin or the like, and a separate member independent from the lower case 10. The bottom plate 80 is fixed to the lower case 10 with a plurality of screws 81 in such a manner that the bottom plate 80 covers the left side swelled part 21L and the right side swelled part 21R from an opposite side to the side where they are swelled (from the bottom side). In this manner, a space for the speaker box spBL and a space for the speaker box spBR are formed as independent spaces.

Shapes of the speaker box spBL and the speaker box spBR are specifically described. As shown in FIGS. 2A, 2B and so on, the speaker box spBL is defined between a left wall part 22L and an opposed wall part 23L in the lateral direction, while the speaker box spBR is defined between a right wall part 22R and an opposed wall part 23R. The left wall part 22L and the right wall part 22R are substantially parallel in the front-rear direction. The opposed wall part 23L and the opposed wall part 23R are opposed to each other in parallel, in an intermediate part in the lateral direction, and inclined rightward in an entire region, in a plan view. A lower region between the opposed wall part 23L and the opposed wall part 23R is defined as the valley part 13. Wall parts which respectively define the speaker box spBL and the speaker box spBR in the front-rear direction are substantially parallel to each other in the lateral direction.

The speakers SPL, SPR are respectively disposed in ceiling parts in higher regions of the swelled parts 21L, 21R (the regions except the stepped parts 24L, 24R). The left wall part 22L and the right wall part 22R are respectively provided with ports 12L, 12R which communicate the swelled parts 21L, 21R to the exterior in the lateral direction. The opposed wall part 23L and the opposed wall part 23R are respectively formed in the region where the stepped parts 24L, 24R are present in the lateral direction. In a plan view, the stepped part 24L has a triangular shape which is pointed to the right side, while the stepped part 24R has a triangular shape which is pointed to the left side, and extended at a front side of the stepped part 24L. The opposed wall part 23L and the opposed wall part 23R have portions which are overlapped with each other in the front-rear direction. In short, there is a region where the opposed wall part 23L and the opposed wall part 23R are coexistent in the lateral direction.

The ceiling part of the left side swelled part 21L (including the stepped part 24L) and the ceiling part of the right side swelled part 21R (including the stepped part 24R) are substantially parallel to each other. The ceiling parts of the higher regions (the regions except the stepped parts 24L, 24R) of the swelled parts 21L, 21R are coplanar with each other. The ceiling parts of the stepped parts 24L, 24R are coplanar with each other. As shown in FIGS. 3A, 3B, the ceiling part of the left side swelled part 21L (including the stepped part 24L) becomes higher in the rearward, that is, the left side swelled part 21L is higher in the rearward, as seen in a side view. In the same manner, the right side swelled part 21R (including the stepped part 24R) is higher in the rearward, as seen in a side view. The valley part 13 may be displaced from the center in the lateral direction. In this embodiment, the valley part 13 is formed at the center in the lateral direction.

Specifically, the higher regions of the left side swelled part 21L and the right side swelled part 21R excluding the stepped parts 24L, 24R are laterally symmetrical in shape, and have the same capacity. On the other hand, the ceiling parts of the stepped parts 24L, 24R become higher in the rearward, as described above, and the valley part 13 is inclined rightward in the plan view. Therefore, the stepped part 24L whose rear region is longer in the lateral direction has the larger capacity than the stepped part 24R whose front region is longer in the lateral direction. As the results, it is possible to secure the larger capacity in the speaker box spBL at the bass side, although the speaker boxes spBL, spBR have the same shape as seen from a direction perpendicular to the ceiling parts of the swelled parts 21L, 21R.

In the speaker box spBL, the opposed wall part 23L is inclined as seen in the plan view (strictly, as seen from the direction perpendicular to the ceiling part of the left side swelled part 21L). Therefore, a distance from the left wall part 22L to the opposed wall part 23L in the lateral direction continuously varies over an entire region. In the speaker box spBR too, a distance from the right wall part 22R to the opposed wall part 23R in the lateral direction continuously varies over an entire region, in the same manner.

Manufacturing process of the electronic keyboard 100 will be described. As a first step, the lower case 10, the upper case 90, and the bottom plate 80 are molded by using molds or the like. Then, the bottom plate 80 is fixed to the lower case 10 on which the speakers SPL, SPR are disposed, by screwing the screws 81 from a lower side of the lower case 10. The keyboard part KB is disposed on the lower case 10, and at the same time, an edge part of the upper case 90 is fixed to an edge part of the lower case 10 with screws or the like. In the manufacturing step, mounting components 17 are disposed in the valley part 13 (FIG. 3B). It is also possible to dispose the mounting components 17 above the stepped parts 24L, 24R which are lower than the respective outside regions of the swelled parts 21L, 21R in the lateral direction. The mounting components 17 include electronic components such as an amplifier, wirings, and so on. It is also possible to provide a concave part which is recessed downward in the ceiling parts of the swelled parts 21L, 21R, and to dispose the mounting components 17 in this concave part.

Because the conventional speaker box basically has a parallelepiped shape, clear standing waves are likely to be formed by reflection of sounds from an inner wall. However, in this embodiment, the opposed wall part 23L and the opposed wall part 23R are respectively inclined with respect to the left wall part 22L and the right wall part 22R which are opposed at an inward side, as seen in a plan view. For this reason, the standing waves, that is, the waves which are standing by interference between inputted waves and reflected waves from the inner wall of the box, and vibrate at a certain amplitude are unlikely to occur. In this manner, disturbance in characteristics of the generated sounds is reduced.

Figure 4:
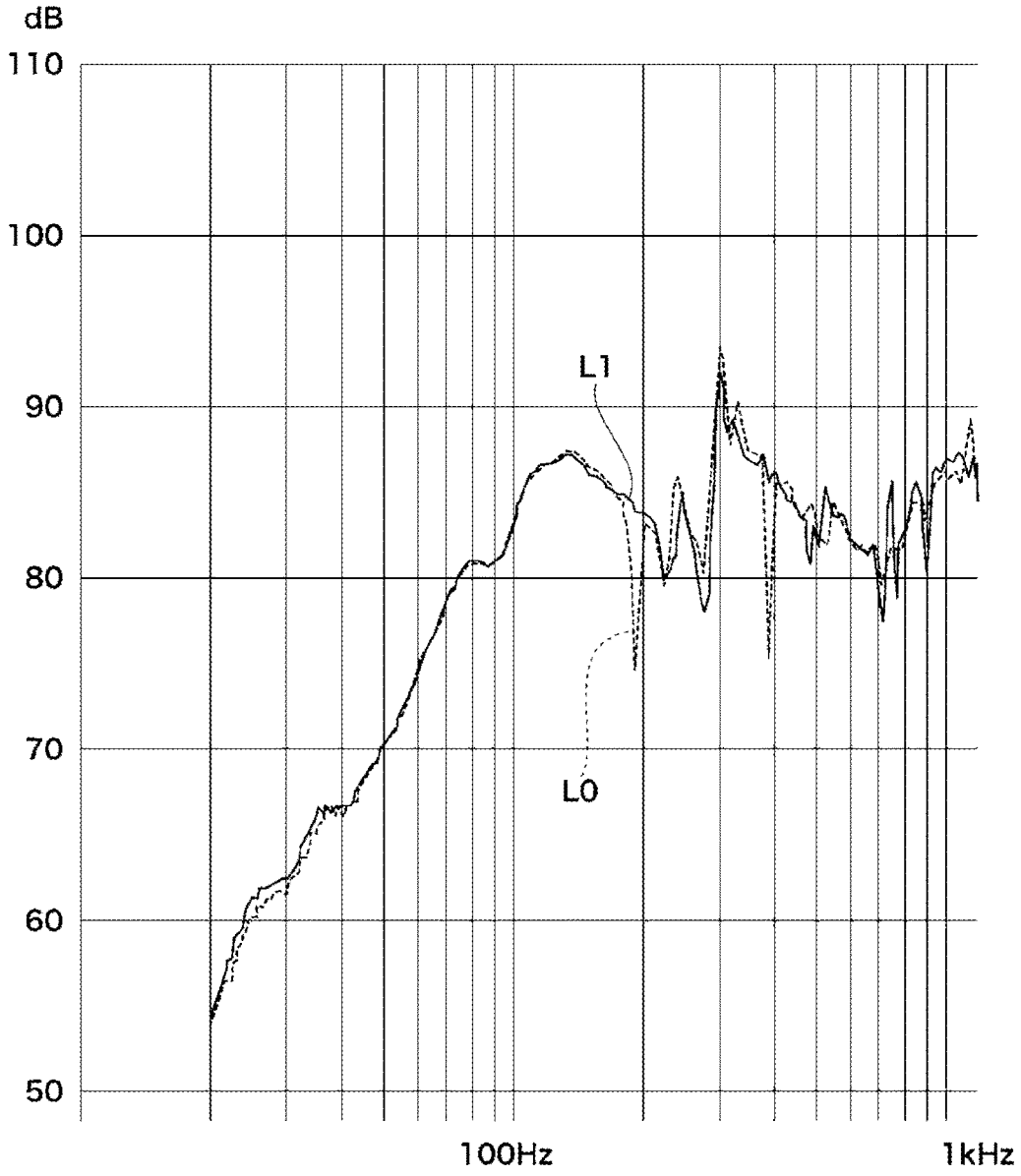
FIG. 4 is a graph showing sound characteristics depending on shapes of speaker boxes.

FIG. 4 is a graph showing characteristics of the sounds depending on the shape of the speaker box. FIG. 4 shows results of volumes of the sounds which were measured at each frequency. The X-axis shows the frequency (kHz), while the Y-axis shows the volume (dB). A curve L0 represents sound characteristics of the speaker box having the conventional shape, and a curve L1 represents sound characteristics of the speaker box in this embodiment. It is found that in a frequency zone higher than 110 kHz or so, undulation of the volume is small in the curve L1, as compared with the curve L0. In short, a so-called disturbance in the characteristics of the sounds is small, in this embodiment.

According to the present embodiment, the opposed wall parts 23L, 23R are inclined in the plan view, and the respective distances from the left wall part 22L and the right wall part 22R to the opposed wall parts 23L, 23R in the lateral direction continuously vary over their entire regions. As the results, it is possible to restrain occurrence of the standing waves.

Moreover, the opposed wall parts 23L, 23R are opposed to each other in parallel, and respectively have the portions which are overlapped with each other in the front-rear direction. Therefore, it is possible to efficiently secure the capacities of the left and right speaker boxes spBL, spBR, while achieving space saving. Particularly, the speaker boxes spBL, spBR are higher in the rearward in the side view, and the opposed wall parts 23L, 23R are inclined in the plan view so as to be positioned rightward in the rearward. As the results, a larger capacity can be advantageously secured in the left side speaker box spBL for the bass range.

Further, the lower case 10 is provided with the left side swelled part 21L and the right side swelled part 21R, and by fixing the bottom plate 80 to the lower case 10 so as to cover the lower case 10 from the opposite side to the side where they are swelled, the spaces for the speaker boxes spBL, spBR are formed. In this manner, it is possible to provide the spaces for the right and left speaker boxes with simple structure and at a low cost.

Moreover, because the mounting components 17 are disposed in the valley part 13 which is formed between the swelled parts 21L, 21R, it is possible to efficiently secure the space for disposing the electronic components, wirings, and so on. Particularly, in the electronic keyboard 100, the keyboard KB is arranged in the front part, and circuit components for key scanning and keyboard operation are desirably arranged near the keyboard KB. The valley part 13 is connected to the keyboard mounting part 11. Therefore, by disposing the mounting components 17 in the valley part 13, it is possible to easily reduce a distance between the keyboard KB and the mounting components 17.

Still further, because the lower case 10 is covered with a single sheet of the bottom plate 80, the lower case 10 which is long-sized in the lateral direction is rigid against a bending force, and advantageous in securing rigidity.

Moreover, the opposed wall parts 23L, 23R respectively have the portions which are overlapped with each other in the front-rear direction, the case body is unlikely to be bent both in the lateral direction and in the front-rear direction, with enhanced reinforcing effect.

Second Embodiment

In the first embodiment, the left side swelled part 21L and the right side swelled part 21R are designed as the two swelled parts of the lower case 10 which is integrally formed. In a second embodiment of the invention, the two swelled parts are defined by using a partition plate.

Figure 5A:
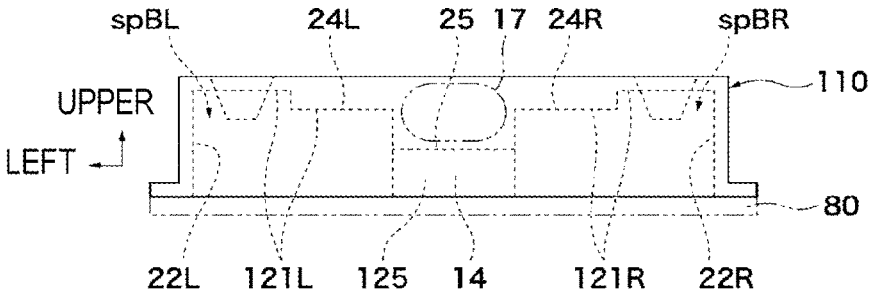
FIG. 5A is a schematic side view of a case body at a lower side in an electronic keyboard to which a speaker box structure according to a second embodiment of the invention is applied.
Figure 5B:
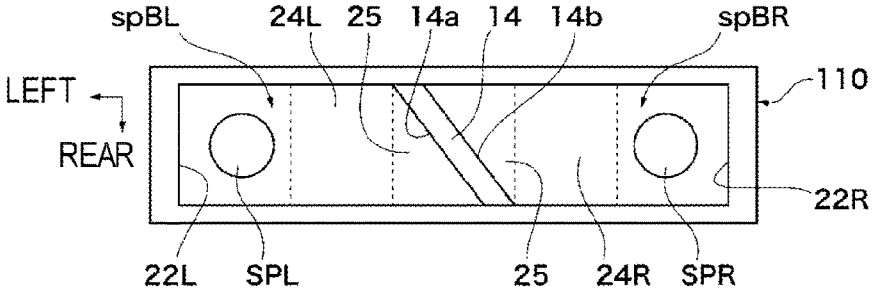
FIG. 5B is a schematic bottom view of the case body at the lower side.

FIGS. 5A and 5B are respectively a schematic side view and a schematic bottom view of a case body at a lower side in an electronic keyboard to which the speaker box structure according to the second embodiment is applied. This case body at the lower side includes the bottom plate 80, and a lowercase 110 corresponding to the lower case 10. The lower case 110 is provided with space parts 121L and 121R corresponding to the swelled parts 21L, 21R. A partition plate 14 is disposed in an intermediate space 125 between the space part 121L and the space part 121R. In the space parts 121L, 121R, the stepped parts 24L, 24R are formed, and at the same time, an intermediate stepped part 25 which is further lower than the stepped parts 24L, 24R by one step is formed at an intermediate position in the lateral direction. The ports are not shown in the drawings.

The partition plate 14 is fixed to a ceiling face, and front and rear inner walls of the intermediate stepped part 25, and inclined in the bottom view (FIG. 5B). As seen in a plan view, the partition plate 14 is so disposed as to be inclined rightward in the rearward. In a state where the partition plate 14 is disposed, the bottom plate 80 is fixed to the lower case 110 so as to cover the lower case 110 from the below, thereby to close the space parts 121L, 121R. In this manner, the spaces for the speaker boxes spBL, spBR are formed.

A left side face of the partition plate 14 is an opposed wall part 14*a* corresponding to the opposed wall part 23L, while a right side face of the partition plate 14 is an opposed wall part 14*b* corresponding to the opposed wall part 23R. Similarly to the opposed wall parts 23L, 23R, the opposed wall part 14*a* and the opposed wall part 14*b* respectively have portions which are overlapped with each other in the front-rear direction, and there is a region where the opposed wall part 14*a* and the opposed wall part 14*b* are coexistent in the lateral direction. The opposed wall part 14*a* is opposed to the left wall part 22L, and the opposed wall part 14*b* is opposed to the right wall part 22R. Both a distance from the left wall part 22L to the opposed wall part 14*a*, and a distance from the right wall part 22L to the opposed wall part 14*b* in the lateral direction continuously vary over their entire regions.

In this manner, the opposed wall parts 14*a*, 14*b* are inclined in the plan view, similarly to the opposed wall parts 23L, 23R, and hence, the standing waves are unlikely to occur. As the results, substantially the same effects as in the first embodiment can be achieved in restraining occurrence of the standing waves.

It is also possible to dispose the mounting components 17 in the intermediate stepped part 25 or above the stepped parts 24L, 24R thereby to efficiently secure a disposing space. It is also possible to make the height of the speaker boxes spBL, spBR higher in the rearward in a side view, in the same manner as in the first embodiment, thereby enabling a larger capacity of the speaker boxes spBL, spBR to be secured. Moreover, the number of the stepped parts may be further increased.

Figure 5C:
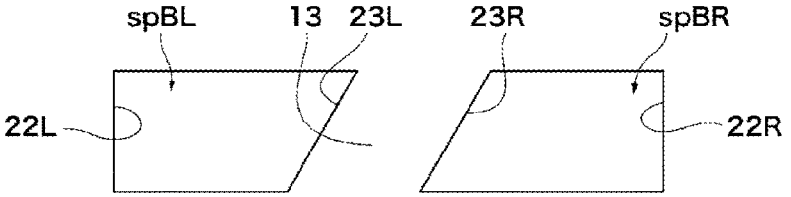
FIG. 5C to 5E are schematic plan views of speaker boxes in modifications.
Figure 5D:
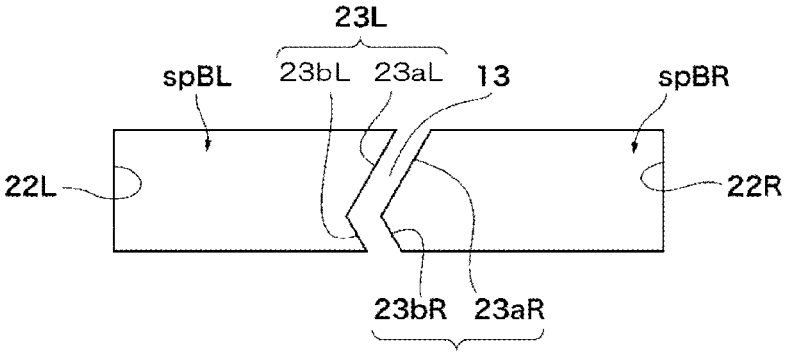
Figure 5E:
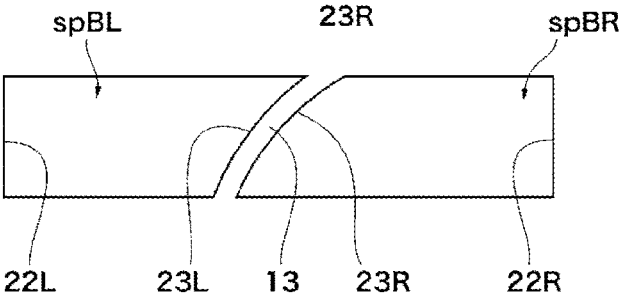

FIGS. 5C to 5E are schematic plan views of the speaker boxes in modifications. The speaker boxes in the modification will be described in FIGS. 5C to 5E, referring to the speaker boxes spBL, spBR which are described in the first embodiment.

In the speaker boxes spBL, spBR as shown in FIGS. 1 to 3, the opposed wall part 23L and the opposed wall part 23R respectively have the portions overlapped with each other in the front-rear direction. However, it is also possible to obtain advantage of restraining the standing waves, even though the opposed wall part 23L and the opposed wall part 23R are opposed in a separate manner, namely, the opposed wall parts 23L, 23R do not have the portions which are overlapped with each other in the front-rear direction, as shown in FIG. 5C.

Moreover, the opposed wall part 23L and the opposed wall part 23R need not be necessarily inclined in the same one direction over the entire regions. It would be sufficient that they have the regions where the distances from the left wall part 22L and the right wall part 22R to the opposed wall part 23L and the opposed wall part 23R continuously vary. For example, as shown in FIG. 5D, the opposed wall part 23L may include an opposed wall part 23*a*L which is inclined rightward in a plan view and an opposed wall part 23*b*L which is inclined leftward in a plan view, and the opposed wall part 23R may include an opposed wall part 23*a*R which is inclined rightward in a plan view and an opposed wall part 23*b*R which is inclined leftward in a plan view. Alternatively, the opposed wall part 23L and the opposed wall part 23R need not be rectilinear in a plan view, but may be curved, as shown in FIG. 5E.

From a viewpoint of securing the capacity of the speaker boxes spBL, spBR, it is advantageous that the opposed wall part 23L, 23R are in parallel with each other. However, they need not be necessarily in parallel. It is to be noted that the modifications as shown in FIGS. 5C to 5E can be applied to the second embodiment too.

Figure 6A:
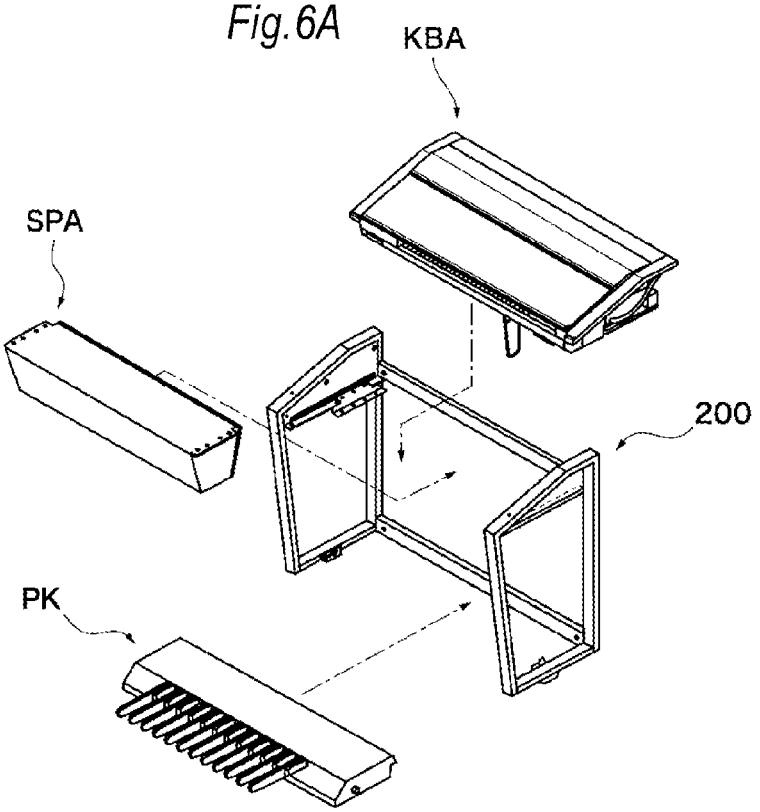
FIG. 6A is an exploded view of an electronic keyboard of assembling type.

The speaker boxes spBL, spBR which are described in the first and second embodiments can be also applied to an electronic keyboard of assembling type, as shown in FIG. 6A. Specifically, a speaker box assembly SPA including the speaker boxes spBL, spBR is produced, and at the same time, a pedal keyboard assembly PK and a keyboard assembly KBA are produced. Then, the speaker box assembly SPA, the pedal keyboard assembly PK and the keyboard assembly KBA are respectively assembled to a pedestal body 200.

Figure 6B:
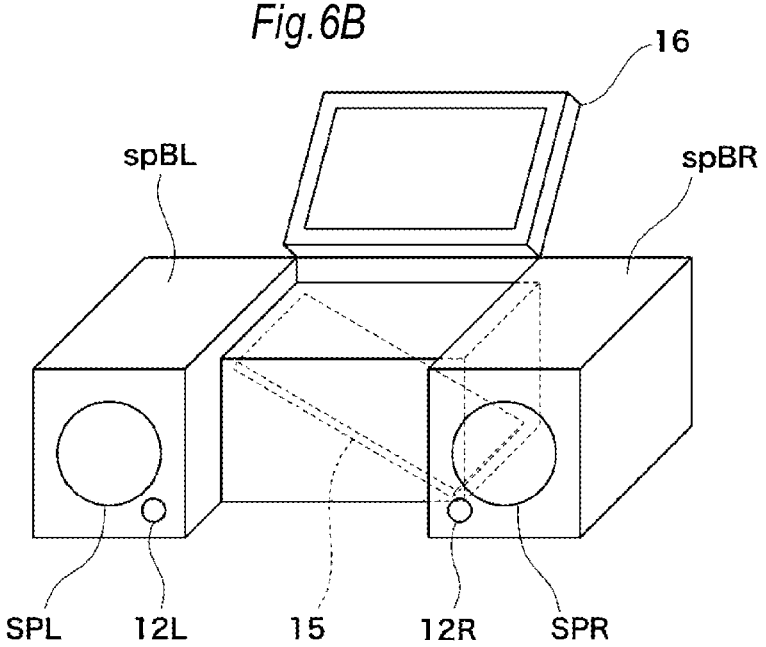
FIG. 6B is a perspective view of a visual audio apparatus.

In the first and second embodiments, an example in which the present invention is applied to the electronic keyboard has been described. However, the invention can be applied to other electronic devices, provided that the devices have the right and left speaker boxes. For example, it is possible to apply the invention to a visual audio apparatus for listening to music or animation, as shown in FIG. 6B. In this apparatus, the speaker boxes spBL, spBR are respectively provided with the speakers SPL, SPR and the ports 12L, 12R which are directed to the front. Moreover, a movable display 16 is provided on a main body. By providing a partition plate 15 in an inclined manner inside a case body, spaces as the left and right speaker boxes spBL, spBR are partitioned.

In the example as shown in FIG. 6B, the partition plate 15 is so arranged as to partition the speaker boxes spBL, spBR both in the vertical direction and in the lateral direction. However, it is also possible to arrange the partition plate 15 so as to partition the speaker boxes spBL, spBR both in the front-rear direction and in the lateral direction.

The present invention has been specifically described referring to the preferred embodiments. However, the invention is not limited to these specified embodiments, but the invention includes various modes within a scope not deviating from the gist of the invention. It is also possible to appropriately combine parts of the above described embodiments.

According to as aspect of the invention, there is provided a speaker box structure of an electronic device, the speaker box structure comprising: a left side speaker box having: a left side wall part; and a first opposed wall part which has a region where a distance in a lateral direction from the left side wall part to the first opposed wall part continuously varies; and a right side speaker box having: a right side wall part; and a second opposed wall part which is opposed to the first opposed wall part in an intermediate part in the lateral direction, and which has a region where a distance in the lateral direction from the right side wall part to the second opposed wall part continuously varies. Due to the above configuration, it is possible to restrain occurrence of standing waves.

The first opposed wall part of the left side speaker box and the second opposed wall part of the right side speaker box may respectively have portions which are overlapped with each other in a front-rear direction. In this case, it is possible to efficiently secure the capacities of the left and right speaker boxes, while achieving space saving.

The first opposed wall part of the left side speaker box and the second opposed wall part of the right side speaker box may be inclined in the same direction over entire regions, as seen in a plan view. In this case, it is possible to enhance an effect of restraining occurrence of the standing waves.

The left side speaker box and the right side speaker box may be higher in a rearward, as seen in a side view, and the first opposed wall part and the second opposed wall part may be so inclined as to be positioned rightward in the rearward, as seen in the plan view. In this case, it is advantageous in securing a large capacity of the left side speaker box for bass range.

The speaker box structure may further comprise: a frame which include a left side swelled part and a right side swelled part which are swelled; and a plate member which is a separate body independent from the frame, and which is fixed to the frame so as to cover the left side swelled part and the right side swelled part from a side opposite to a side where the left side swelled part and the right side swelled part are swelled, thereby to forma space for the left side speaker box and a space for the right side speaker box. In this case, it is possible to provide the spaces for the right and left speaker boxes with simple structure and at a low cost.

An electronic component or a wiring may be disposed in a valley part which is formed between the left side swelled part and the right side swelled part. In this case, it is possible to efficiently secure the space for disposing the electronic component, wiring, and so on.

At least one of the left side swelled part and the right side swelled part may have a stepped part which is lower than an outward region in the lateral direction. An electronic component or a wiring may be disposed on the stepped part. In this case, it is possible to efficiently secure the space for disposing the electronic component, wiring, and so on.

What is claimed is:

1. A speaker box structure of an electronic device, the speaker box structure comprising:

a left side speaker box having:

a left speaker for generating left-box sounds, the left speaker directed in a speaker-facing direction;

a left side wall part; and a first opposed wall part located opposite to the left side wall part in a lateral direction, wherein a distance in the lateral direction from the left side wall part to the first opposed wall part continuously varies to restrain occurrence of standing waves formed by reflection of sounds, from among the left-box sounds, inside the left side speaker box; and a right side speaker box having:

a right speaker for generating right-box sounds, the right speaker directed in the speaker-facing direction;

a right side wall part; and a second opposed wall part located opposite to the right side wall part in the lateral direction, wherein a distance in the lateral direction from the right side wall part to the second opposed wall part continuously varies to restrain occurrence of standing waves formed by reflection of sounds, from among the right-box sounds, inside the right side speaker box, wherein an extending direction of the left side wall part is substantially parallel to an extending direction of the right side wall part, the lateral direction is substantially perpendicular to extending directions of the left side wall part and the right side wall part, the first opposed wall part and the second opposed wall part are located opposite to each other in the lateral direction, and the first opposed wall part and the second opposed wall part are disposed in between the left side wall part and the right side wall part, the speaker-facing direction is substantially perpendicular to both the lateral direction and the extending directions of the left and right side wall parts, and the first and second opposed wall parts are formed as extending in a direction substantially opposite to the speaker-facing direction.

2. The speaker box structure according to claim 1, wherein the first opposed wall part of the left side speaker box and the second opposed wall part of the right side speaker box respectively have portions which are overlapped with each other in a front-rear direction, the front-rear direction being perpendicular to the lateral direction as seen in a plan view.

3. The speaker box structure according to claim 2, wherein the first opposed wall part of the left side speaker box and the second opposed wall part of the right side speaker box are inclined in the same direction over their entire regions, as seen in the plan view.

4. The speaker box structure according to claim 3, wherein the left side speaker box and the right side speaker box are higher in their rearward regions, as seen in a side view, and the first opposed wall part and the second opposed wall part are so inclined as to be positioned rightward in the rearward regions, as seen in the plan view.

5. The speaker box structure according to claim 1, wherein the first opposed wall part of the left side speaker box and the second opposed wall part of the right side speaker box are inclined in the same direction over their entire regions, as seen in a plan view.

6. The speaker box structure according to claim 5, wherein the left side speaker box and the right side speaker box are higher in their rearward regions, as seen in a side view, and the first opposed wall part and the second opposed wall part are so inclined as to be positioned rightward in the rearward regions, as seen in the plan view.

7. The speaker box structure according to claim 1, wherein the distance in the lateral direction from the left side wall part to the first opposed wall part continuously varies along the extending direction of the left side wall part, and the distance in the lateral direction from the right side wall part to the second opposed wall part continuously varies along the extending direction of the right side wall part.

8. The speaker box structure according to claim 1, further comprising:

a frame integrally formed with both the left side speaker box and the right side speaker box so that the left side speaker box and the right side speaker box are fixed in position relative to each other.

9. A speaker box structure of an electronic device, the speaker box structure comprising:

a left side speaker box having:

a left side wall part; and a first opposed wall part located opposite to the left side wall part in a lateral direction, wherein a distance in the lateral direction from the left side wall part to the first opposed wall part continuously varies to restrain occurrence of standing waves in the left side speaker box;

a right side speaker box having:

a right side wall part; and a second opposed wall part located opposite to the right side wall part in the lateral direction, wherein a distance in the lateral direction from the right side wall part to the second opposed wall part continuously varies to restrain occurrence of standing waves in the right side speaker box;

a frame which includes a left side swelled part and a right side swelled part which are swelled; and a plate member which is a separate body independent from the frame, and which is fixed to the frame so as to cover the left side swelled part and the right side swelled part from a side opposite to a side where the left side swelled part and the right side swelled part are swelled, thereby to form a space for the left side speaker box and a space for the right side speaker box, wherein an extending direction of the left side wall part is substantially parallel to an extending direction of the right side wall part, the lateral direction is substantially perpendicular to extending directions of the left side wall part and the right side wall part, the first opposed wall part and the second opposed wall part are located opposite to each other in the lateral direction, and the first opposed wall part and the second opposed wall part are disposed in between the left side wall part and the right side wall part.

10. The speaker box structure according to claim 9, wherein an electronic component or a wiring is disposed in a valley part which is formed between the left side swelled part and the right side swelled part.

11. The speaker box structure according to claim 9, wherein at least one of the left side swelled part and the right side swelled part has a stepped part which is lower than an outward region in the lateral direction.

12. The speaker box structure according to claim 11, wherein an electronic component or a wiring is disposed on the stepped part.

* * * * *